United States Patent [19]

Mayn

[11] 3,947,675

[45] Mar. 30, 1976

[54] COMPUTER INTERACTIVE RESISTANCE SIMULATOR (CIRS)

[75] Inventor: Bobby G. Mayn, Pleasanton, Calif.

[73] Assignee: The United States of America as represented by the United States Energy Research and Development Administration, Washington, D.C.

[22] Filed: Jan. 3, 1975

[21] Appl. No.: 538,490

[52] U.S. Cl. ..... 235/184; 235/194; 328/160; 338/13

[51] Int. Cl.[2] ..... G06G 7/62

[58] Field of Search ..... 235/184, 185, 194, 195; 328/160; 338/13, 20

[56] References Cited

UNITED STATES PATENTS

| | | | |
|---|---|---|---|
| 2,401,447 | 6/1946 | Wipff | 328/160 |
| 2,860,241 | 11/1958 | Post | 235/195 |
| 3,396,267 | 8/1968 | Dietrich | 235/184 |
| 3,562,553 | 2/1971 | Roth | 235/194 |
| 3,633,005 | 1/1972 | Leighton | 235/194 |

*Primary Examiner*—Felix D. Gruber
*Attorney, Agent, or Firm*—Dean E. Carlson; John A. Koch

[57] ABSTRACT

A system for simulating the insertion of electric resistance values of either positive or negative quantity into an electric circuit and for cancelling drift errors therefrom.

10 Claims, 3 Drawing Figures

COMPUTER INTERACTIVE RESISTANCE SIMULATOR (CIRS)

BACKGROUND OF THE INVENTION

This invention described herein was made in the course of or under Contract AT(29-1)-1183 with the U.S. Atomic Energy Commission.

This invention relates to an electric resistance simulator and more particularly to a system for simulating the addition or subtraction of desired resistance values to and from an electric circuit from a remote location.

There are many instances where it is necessary to obtain information regarding some phenomenon occurring at a remote location. Frequently the phenomenon is observed by a detector-transducer which in conjunction with associated electrical circuitry translates some effect of the observed phenomenon into electrical signals which are in turn transmitted to a location where the signal is recorded and processed into meaningful data.

Generally, the response of detectors and the circuits utilized with them varies with the time, temperature and other changes to the environment in which the circuit is utilized. Accordingly, in order for the data obtained to accurately represent the phenomenon observed it is necessary that the detector circuit be calibrated prior to its use in the aquisition of the data.

Calibration of detector circuits is generally accomplished by individually putting a number of resistances of known values into the circuit and recording the response of the circuit with each such resistance value. This is usually accomplished by physically inserting subtracted resistances into the detector circuit. When the phenomenon to be observed is truly remote from the data recording station it requires at least two technicians, one at the remote location and one at the recording location, and a communication system between them. While this is inconvenient and cumbersome at best, it can be particularly troublesome in instances where the event to be observed does not occur at a set or anticipated time and/or the environment in which the circuit is used is subject to changes which significantly affect the response of the circuit. Moreover, resistance values can not be substracted from the circuit. The inability to subtract resistance values is particularly troublesome when the detector to be used is of the type which decreases in resistance value when excited by a stimulus.

SUMMARY OF THE INVENTION

Therefore, it is an object of this invention to provide a resistance simulator circuit. It is a further object of the invention to provide a resistance simulator circuit which permits accurate resistance values, of either positive or negative value, to be added into a circuit from a location remote therefrom. It is also an object of the invention to provide the capability for sensing the deviation in resistance value of a circuit from calibration values and inserting resistance values into the circuit to compensate for these deviations.

Briefly stated, the above indicated and additional objects and advantages are achieved by a combination of electric circuit components including a first amplifier which provides an output voltage equal to a constant times the unknown current in the detector circuit, a multiplier which receives the output of the first amplifier as a first input and a second input of a selected value to provide an output which is the product of the selected value, a constant and the unknown current, and a second amplifier which receives the output of the multiplier as a first input and an error correction voltage as a second input to provide an output voltage equal to the product of a constant, the selected input into the multiplier and the unknown current.

Since of the factors making up the output voltage, the only unknown is the current, the output voltage is equivalent to the unknown current times a resistance, the value of which can be controlled by the selection of values for the second input to the multiplier. Since the value selected as the second input to the multiplier can be either negative or positive, a selected, simulated resistance value can be either added to or subtracted from the circuit of interest.

The addition of an error memory device permits drift errors in the detection circuit to be automatically zeroed out. This is accomplished by making the selected input into the multiplier zero, storing the output from the combination with that selected zero input and inserting it into the second amplifier as an error signal when the detector circuit is in operation.

The above mentioned and additional objects and advantages of the invention as well as further understanding of the invention will appear after consideration of the following description of a preferred embodiment in conjunction with the accompanying drawings.

DESCRIPTION OF PREFERRED EMBODIMENT

Figure 1:
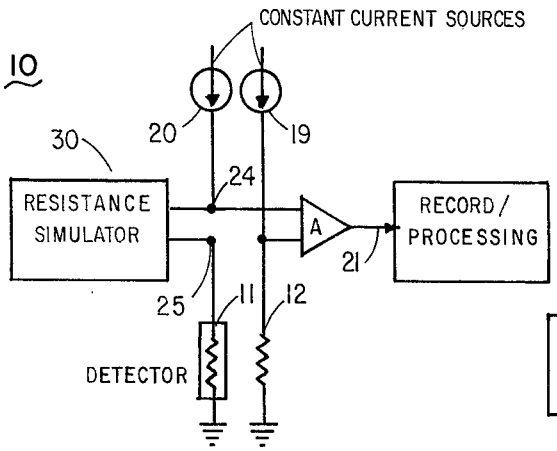
FIGS. 1 and 2 illustrate the use of the invention in two similar, typical circuits.
Figure 2:
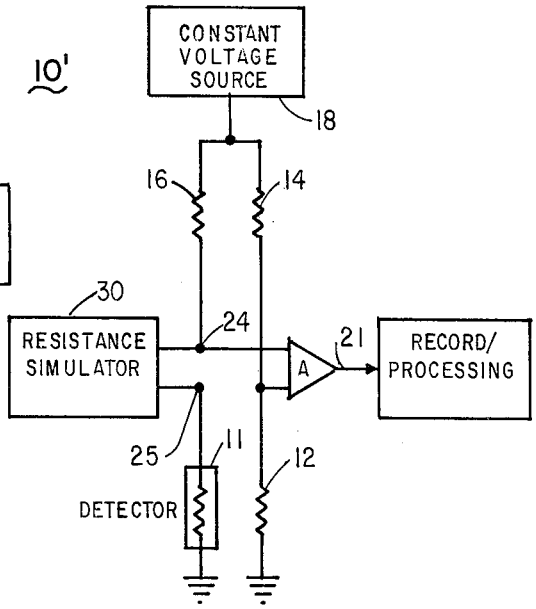
Figure 3:
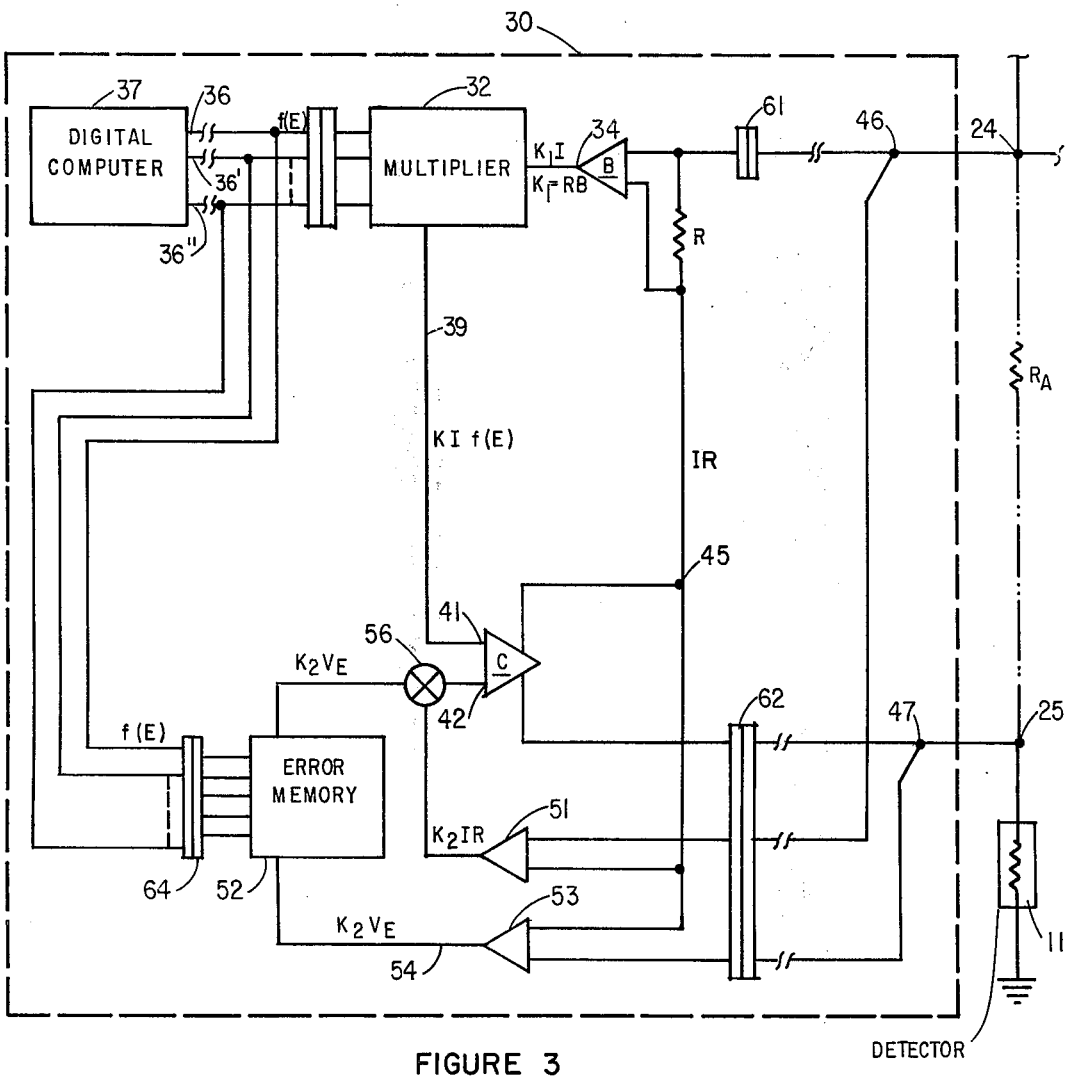
FIG. 3 is a circuit diagram of a preferred embodiment of the invention.

Prior to embarking on a description of the resistance simulator according to the invention, which is shown in detail in FIG. 3, a brief look at two typical detector circuits shown in FIGS. 1 and 2 may be of some benefit. Identical components in the figures are identified by the same reference character or letter. Both of the circuits 10 and 10' employ a detector transducer 11 in a bridge circuit. In FIG. 2 the bridge includes resistors 12, 14 and 16 with a constant voltage from source 18 applied thereacross whereas in FIG. 1 it includes resistor 12 and constant current sources 19 and 20. Imbalances in the bridge circuits of FIGS. 1 and 2 due to the effect of some phenomenon on respective detectors 11 are sensed and amplified by amplifier A and the output 21 of amplifier A is utilized as an analog of the particular effect sensed by detectors 11. Those familiar with the detector circuitry art will appreciate that various components of circuits 10 and 10' can be physically positioned some distance away from other components.

Calibration of the circuits 10 and 10' of FIGS. 1 and 2 has heretofore generally been accomplished by physically inserting a number of resistances of known value in that leg of the bridge containing detector 11 between junctions 24 and 25 and recording the response of the circuit with each. However, the connection of detector 11 into the bridge circuit through resistance simulator 30 - shown in block form on FIGS. 1 and 2 and in schematic detail in FIG. 3 - permits detector circuits 10 and 10' to be calibrated from a remote location and provides other advantages as will be presently described.

The individual components making up the preferred embodiment illustrated in FIG. 3 of the resistance simulator 30 according to the invention will now be described in conjunction with the function each performs in accomplishing the desired result. As shown in each figure of the drawing, resistance simulator 30 is connected across points 24 and 25 to complete the bridge of a detector circuit such as 10 or 10'. It will be appreciated as the description proceeds that the actual physical location of some of the components making up simulator 30 will be remote from others in the usual application thereof. As will be seen, the effect of simulator 30 in the detector circuit is analagous to the insertion of an apparent resistance, $R_A$, of constant, preselected value between points 24 and 25, the value of $R_A$ being determined by the following.

Current I in the leg of the bridge including detector 11 flows through resistance R thereby developing a voltage drop $-E_R = I \cdot R-$ across the inputs of D.C. amplifier B. The output voltage of amplifier B at 34 is equivalent to a constant $K_1$ times the current I, the value of $K_1$ being the product of the value of resistance R times the amplification factor B of amplifier B.

The output 34 of amplifier B, i.e. $K_1I$, is fed into multiplier 32 as a first input thereto. The second input into multiplier 32 is a preselected input designated $f(E)$ from source 37. Output 39 of multiplier 32 is therefore the product of the two inputs thereto, $K_1I \cdot f(E)$.

In the preferred arrangement multiplier 32 would be of the multiplying DAC (digital to analog converter) type, source 37 would be a digital computer and inputs 36, 36', 36'' etc. would be a series of discrete digital inputs which would be converted to analog by the multiplying DAC. It will be appreciated that while source 37 provides the input $f(E)$ utilized in the resistance simulator, a digital computer utilized as source 37 would ordinarily be physically located some distance from the remainder of the circuit and that the provision of the input f(E) for resistance simulator 30 would be merely one of many possible functions of the digital computer.

Output 39 of multplier 32 is connected as the first input 41 of D.C. amplifier C. As shown, amplifier C is connected in the differentiating mode, the output therefrom appearing across junctions 45 and 47. If the second input 42 to amplifier C had a zero value at this point, the output of the device across points 24 and 25 would be $K_1If(E)C + IR$. However, by sensing the voltage between points 45 and 46 and utilizing it as the input to amplifier 51, the second input 42 to amplifier C becomes equal to $K_2IR$. Accordingly, the output of the device across points 24 and 25 is actually $K_1If(E)C-+IR-K_2IRC$. By selecting the values of $K_2$ and C so that their product is one, the output of the device becomes $K_1If(E)C$.

Therefore, it can be seen that the output of the device is equivalent to the unknown current I times an apparent resistance the value of which is equal to the product of the resistance R, amplification factor B, amplification factor C and the input $f(E)$. Accordingly, the value of apparent resistance $R_A$ can be manipulated to any desired value by the manipulation of $f(E)$. Since the value of $R_A$ is independent of I, the device can be utilized with either the constant current sources of FIG. 1 or the constant voltage source of FIG. 2. Moreover, the ability of amplifier C to swing either negative or positive permits a negative resistance to be simulated by the appropriate manipulation of $f(E)$. Since resistance simulator 30 is isolated from other portions of the detector circuitry, it floats with the voltage that is induced across detector 11 at any particular time.

The addition of error memory device 52, amplifier 53 and the sensing of voltage $V_E$ across points 46 and 47 makes it possible to automatically compensate for errors that may develop in the system. This is accomplished in the following manner.

Input $f(E)$ is set to zero. With $f(E)$ at zero, voltage $V_E$ sensed across points 45 and 47 represents the total error in the circuit. That error is amplified by amplifier 53 to provide an output $K_2V_E$ at 54 which is digitized and stored by error memory circuit 52. The $K_2V_E$ input to error memory 52 is then converted to a stored analog signal. Inputting $f(E)$, i.e., digital inputs 36, 36', 36'' etc. into error memory 52 allows the error memory to be loaded with $K_2V_E$ only when input f(E) is zero. The $K_2V_E$ value is combined through summation point 56 with the input from amplifier 51 as input 42 to amplifier C. Accordingly, the output of the device with the $f(E)$ input set at zero will be $V_E+IR-(K_2IRC+K_2V_EC)$. Since $K_2$ and C are reciprocals, that output would be zero and detector circuits 10 (and 10') would respond to a sensed stimulus as though no error were present therein.

Connector blocks 61, 62, 63 and 64 permit the resistance simulator to be positioned at a location remote from detector 11 and remote from digital computer 37.

The capability which the invention provides to remotely sense and manipulate resistance values — which, it has been found, can presently be controlled to within ½ of 1% — and to zero out errors has proven to be very beneficial in connection with detector circuitry as previously indicated. The ability to leave the simulated resistance in line during actual use of the detector circuit is a very useful feature in detector circuitry. However, the invention is by no means limited to application with detector circuitry. It can be beneficially used in various types of circuits where a capacity to change resistance values is necessary or desirable. As an example, the change in amplifier gains by the manipulation of input resistance values could be readily accommodated through use of the invention. Moreover, the ability to add negative resistance values to a circuit which the invention provides will undoubtedly prompt investigation of its use in the advancement of the state of the art in many areas.

While the fundamental novel features of the invention have been shown and described and pointed out as applied to particular embodiments by way of example, it will be appreciated by those skilled in the art that various omissions, substitutions and changes may be made within the principle and scope of the invention as expressed in the appended claims.

What I claim is:

1. A combination of components for simulating the insertion of selected resistances of either positive or negative values in an electric circuit comprising:

a. a first amplifier means for providing an output voltage equal to a constant times a current in said circuit, b. a multiplier operatively connected to said first amplifier for receiving said output therefrom, c. means for providing a selected input of a manipulated value into said multiplier as a second input thereto whereby the output of said multiplier is the product of said selected input, a constant and said current, and d. a second amplifier means, operatively connected to said multiplier to receive said output therefrom as a first input and operatively connected to receive an input representative of the input to said first amplifier means as a second input, for providing an output of said combination equal to the product of a constant, said selected input and said current.

2. The combination of claim 1 wherein said first amplifier means include an amplifier having a resistance through which said current flows across its two inputs whereby the input into said first amplifier means is equal to said current times said resistance.

3. The combination of claim 2 wherein said circuit is a bridge circuit having a detector in one leg thereof and said current flows in said leg and through said resistance connected across said amplifier of said first amplifier means.

4. The combination of claim 2 wherein:

a. the junctions of said combination with said circuit are at the first input of said amplifier of said first amplifier means and the second output of said second amplifier means, which second amplifier means is connected in the differentiating mode and, b. the second input of the amplifier of said first amplifier means is connected to the first output of said second amplifier means.

5. The combination of claim 4 wherein said circuit is a bridge circuit having a detector in one leg thereof and said current flows in said leg and through said resistance connected across said amplifier of said first amplifier means.

6. The combination of claim 1 wherein said selected input is a discrete value.

7. The combination of claim 6 wherein said selected input is a digital input converted to analog.

8. The combination of claim 7 wherein said multiplier is of the multiplying DAC type.

9. The combination of claim 1 additionally including means for sensing voltage representative of error in the circuit across selected points in said combination and inputting said voltage into said second amplifier means as an error signal.

10. The combination of claim 9 additionally including means for retaining said error signal when said selected input is zero and inputting said retained signal into said second amplifier thereby oompensating for said error signal in the electrical output of said combination.

* * * * *